United States Patent [19]

Johns

[11] Patent Number: 4,457,405

[45] Date of Patent: Jul. 3, 1984

[54] CAR AND HOISTWAY DOOR COUPLING APPARATUS

[75] Inventor: Calvin E. Johns, Tampa, Fla.

[73] Assignee: Otis Elevator Company, Farmington, Conn.

[21] Appl. No.: 264,889

[22] Filed: May 18, 1981

[51] Int. Cl.[3] ..... B66B 13/00

[52] U.S. Cl. ..... 187/52 LC; 49/103; 49/116

[58] Field of Search ..... 187/51, 52 R, 52 LC, 187/56, 57, 61, 49, 50; 49/103, 73, 116

[56] References Cited

U.S. PATENT DOCUMENTS 3,638,762 2/1972 Johns ..... 187/61

3,738,454 6/1973 Atkey ..... 187/52 LC

*Primary Examiner*—Joseph J. Rolla

*Assistant Examiner*—Kenneth Noland

*Attorney, Agent, or Firm*—Robert E. Greenstien

[57] ABSTRACT

An apparatus is provided which couples a car door and a hall door in an elevator system. The apparatus includes a roller which is spring loaded into a first position for engaging a vane on the car door and which is movable from that first position for disengaging the vane if the vane is on the wrong side of the roller. The apparatus allows the car door to open and close the hall door by engaging this roller and, if the vane is on the wrong side of the roller, nevertheless, allows the car door to close.

2 Claims, 3 Drawing Figures

FIG. 1
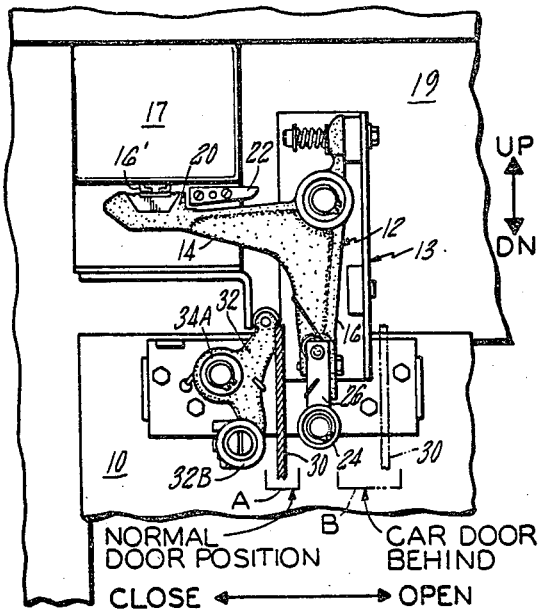
FIG. 3
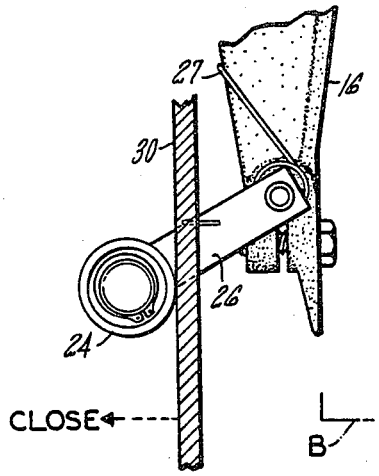
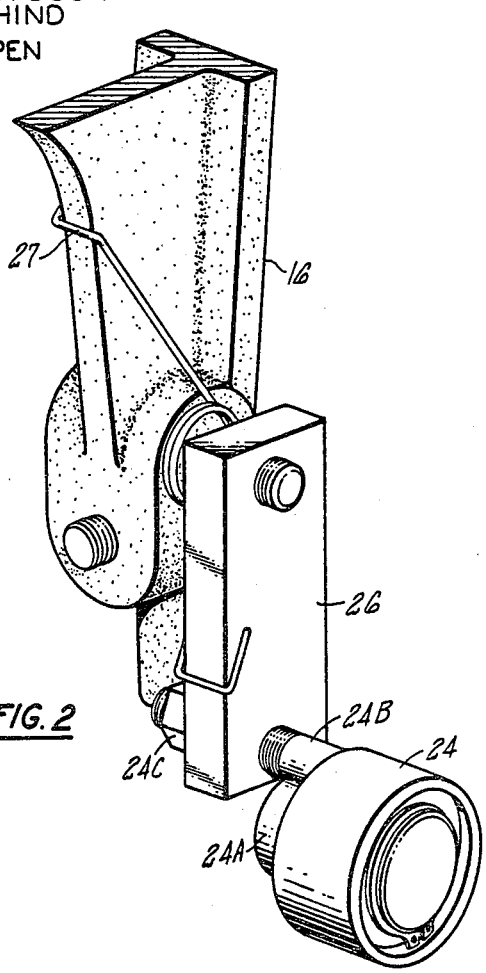
FIG. 2

CAR AND HOISTWAY DOOR COUPLING APPARATUS

CROSS-REFERENCE TO RELATED APPLICATIONS

The subject matter of this application relates to the subject matter of copending application Ser. No. 54,524 by Calvin E. Johns for a MAGNETIC ROLLER, which was filed on July 2, 1979 and which is also assigned to the Assignee of this application.

TECHNICAL FIELD

This invention relates to devices used in elevator systems to couple the car and hall doors so that the car door may be used to open and close the hall door.

BACKGROUND ART

In many elevator systems the elevator car door is coupled to the hall door at each floor to prevent the car from moving when the hall door is open and to enable the car door to open and close the hall door synchronously at the floor. U.S. Pat. No. 3,638,762 to Johns on a DOOR COUPLING APPARATUS FOR ELEVATORS, which is also assigned to the Assignee of this application, shows a device for that purpose. The previously mentioned copending application, also by Johns, on a MAGNETIC ROLLER, pertains to an enhanced version of that patented coupling device or apparatus.

Comprising two rollers, which are attached to the hall door, that apparatus operates in conjunction with a vertical vane, which is carried on the car door and which fits between these two rollers when the car is at the floor. As the car door opens, this vane pulls on one of the rollers, and this action couples the two doors together, and thus, as the car door opens, it opens the hall door. This roller also controls the position of a spring loaded arm, on which it is attached, and which, in response to the pressure of the vane, rotates to operate a switch which prevents the car from moving when the hall doors are even slightly open. This arm also locks the hall doors closed. In the reverse mode, as the car door closes, the vane pushes on the other roller. This action couples the two doors together and, thus, as the car door closes, it closes the hall door. When the hall door is just about fully closed, the previously mentioned arm rotates, operating the switch so as to permit the car to move, which it can do safely now that both doors are closed. For this arrangement to operate properly, the vane must be positioned between the two rollers when the car is at the floor. If it is not—if it is positioned on the outside, for example, which is known as a "door behind" condition—not only will the hoistway door not open as the car door opens, but the car door will not fully close. If that happens, car door position sensing apparatus, which are typical in most systems, will sense the partially open car door position and prevent the car from moving any further. The car is thus immobilized at the floor, with the car door slightly open and with the hall door fully closed. The only way to correct that is to move the car away from the floor, so that the car door can fully close, but, since the car is immobilized, that requires overriding the system's safety controls, which typically can be done only by a service technician.

The door behind condition does not occur frequently, but, as it can be appreciated, when it does happen, it may cause a lengthy service disruption which requires repair by a service technician. In most instances it happens because, at the floor, there is a temporary misalignment between the car door and the door coupling apparatus. One place it may occur is in elevator systems that have advanced car door opening sequences in order to reduce car flight time. It is possible, in those systems, that the car door may open too quickly, that is, too far in advance of the floor, and, thus, when the car reaches the floor, the door is open at a point where the vane is behind the roller.

DISCLOSURE OF INVENTION

An object of the present invention is to provide that type car and hall door coupling for opening and closing the hall door with the car door and locking the hall door closed, and, also, to enable the car door to close from a door behind position.

According to the invention, the roller that is located on the hall door locking switch velocity arm—on which the vane rests to open the hall door—is allowed to pivot in one direction only to allow the vane to move from a door behind position. If the vane is located normally, on the other side of the arm, the roller does not pivot and instead locks against the arm, enabling the vane to rest on it for normal operation to operate the arm and open and close the hall door. To achieve this unidirectional pivoting action, the roller is attached to an arm which pivots on the lock and switch actuating arm and which is biased to a locked position by a spring.

The invention provides a significantly enhanced door coupling apparatus, compared to those previously available. It virtually eliminates service disruptions associated with the door behind condition and achieves that because under virtually no condition can the car door become stuck behind the arm. For normal operation, however, the apparatus embodying the invention performs the same as existing type ones in coupling the car and hall door together through the vane so that the hall door can open and close synchronously with the car door.

A feature of the invention is that it can be easily retrofitted into elevator systems which already use the door coupling apparatus which have a nonpivoting roller, such as the type shown in Johns' previously mentioned U.S. patent and copending application. In addition to those already enumerated, other objects, aspects, benefits and features of the invention will be apparent to one skilled in the art.

BRIEF DESCRIPTION OF DRAWINGS

FIG. 1 is an elevational view of a door coupling apparatus which embodies the invention; it shows the vane in a normal position, between the two rollers, and in the "door behind" position, outside the switch actuating arm and roller assembly;

FIG. 2 is a perspective view of the lower portion of that assembly; and

FIG. 3 is an elevational view of the lower portion of the assembly and the vane, after it has moved from the door behind to normal position.

BEST MODE FOR CARRYING OUT THE INVENTION

Referring to FIG. 1, it shows a door coupling apparatus which, similar to the previously mentioned Johns' patent and copending application, couples a car door (not shown) to a hall door 10 when the car is at a floor, so that the hall door opens and closes as the car door opens and closes, the hall door is locked closed automatically when the car is not at the floor, and a hall door open condition is sensed. The apparatus includes a pivoting arm assembly 12 which is attached to a bracket 13 on the hall door 10 (partially shown). This arm assembly has first and second legs 14 and 16 which are roughly at right angles to each other. The leg 14 engages a mechanical switch control 16' to operate a switch which is in a switch case 17 that is attached to the door jamb 19. The switch is operated as the arm rotates when the hall door is open, and provides a hall door open signal. That signal, as is well known, is received by the system controller (not shown) which, for safety reasons, inhibits car motion while the hall door is open. The leg 14 contains a boss 20 and this boss registers with a land 22 on the hall door jamb 19 to lock the hall door closed. The second leg 16 supports a roller 24 which is rotationally mounted on another small arm 26. This arm 26 is pivotally attached near the end of the second leg and, in the counterclockwise direction to the "down" or at rest position shown in FIG. 1, by a spring 27 which grabs the arm and the leg, the arm 26 is biased. If forced to the left (the clockwise direction) against the spring, the arm 26 will pivot on the leg, but the spring will automatically return it to the at rest position when the force is removed. The arm may be attached to the second leg in a number of ways. One way is to have it attached to a stud which is simply screwed into the arm. (In fact, for retrofitting apparatus shown in Johns' U.S. patent and copending application, the arm may be mounted on the shaft that is used to support the roller normally found at that location.) The roller 24 rotates on a pin 24A, and, so that the roller's position relative to the arm assembly 12 may be adjusted, the pin 24A is mounted on an eccentric shaft to the arm 26 by a bolt 24B. The bolt 24B is held in place by nuts 24C which, to lock the roller in its at rest position, rest on the arm when the roller is down (as FIG. 3 shows). (It should be noted, that the arrangement comprising roller 24 and pin 24A is found in the earlier Johns' devices, and, therefore, they can be used when retrofitting the device with the invention.)

FIG. 1 also shows a portion of a vertical vane 30 which is attached to the door of a car at the floor. In FIG. 1, this vane is located in a "normal" zone A between the roller and another spring loaded arm assembly 32, which contains two rollers 32A, 32B. (The assembly's operation, which does not pertain to the invention, is described in the Johns' U.S. patent, supra.) As FIG. 1 demonstrates, the vane is moved to the right to open the car or to the left to close it. The vane extends inwardly from the car door towards the hall door only far enough to engage the rollers 24, 32A, 32B. However, FIG. 1 shows, in dotted lines, another vane position representing a door behind condition, which occurs whenever the vane is located with the "car door behind" zone B. That zone B begins at the left edge of the roller 24 and extends to the right. The door behind condition may happen because the car door opened before it came to the floor, and, if it has happened, the car door will fully open (causing the vane to move to the right), but, when it tries to close all the way, the vane will strike the roller 24. If the roller could not pivot (as in the prior art), the car door would not close fully. Assuming, for illustrative purposes, that the roller 24 cannot pivot, the car door will thus be partially open, with the vane lodged against the right edge of the roller. Door position sensing apparatus, which is typically found in most systems to permit the car to move only if the door is fully closed (there might be an obstruction in the door), would then sense that condition and prevent the car from moving any further. This is what happens in a door behind condition in a system that uses the prior art devices in which, unlike the device embodying the invention, the roller 24 is fix mounted to the arm—cannot pivot or swing out of the way to allow the door to close. Obviously, if the car could be moved above the floor, the vane would clear the roller and the door would then fully close. The door position safety equipment prevents that, however.

FIG. 3 demonstrates that when the vane 30 is moving in the closing direction, it engages the roller, but, because the roller is pivotally mounted, the vane pushes it aside, pivoting it in the clockwise direction, to allow the vane (and the door to which it is connected) to move into the normal position zone A, in which the car door is closed. Once the car door is in zone A, the car may resume normal operation, move away from the floor, either up or down, in response to other call assignments. As the car moves away from the floor, the vane will cease to engage the roller and the roller, under the action of the spring on the arm 26, will be pivoted back to the at rest position (its position in FIG. 1). Hence, despite the occurrence of a door behind condition, there has been no disruption in service, except the hall door has not opened on the floor where the door behind condition occurred.

In Johns' U.S. patent and his copending application, the roller found on the switch actuating arm is magnetized, for reasons explained there. In his U.S. patent the roller is magnetized one way, and his copending application relates to techniques for having stronger magnetic rollers. Although it is not shown here, the roller 24 on the switch actuating arm may also be magnetized and constructed according to either technique.

As stated earlier, a feature of the invention is that it can be retrofitted easily into existing systems comprising the switch actuating, door lock arm with a conventional nonpivoting roller. To retrofit such a system, the roller is removed and the pivoting arm is installed on the shaft along with the spring. The components that are already on the arm can be used in this way. The nonpivoting roller (comparable to roller 24) in the existing device is removed; the pivoting arm is attached along with the spring on the remaining roller pin, which may be threaded first, if necessary, and the existing roller assembly is attached (e.g. welded) to the bolt 24B which, with the nuts 24C, is attached to the end of the pivoting arm. The roller 24 and arm are thus installed. The position of the roller 24 is then adjusted (by rotating it on the arm 26) for proper vane clearance in the normal zone A and then the nut 24C is tightened to lock the roller in place on arm 26.

In addition to those previously described, for exemplary purposes, other modifications, variations and alterations in and to the embodiments described previously will be apparent to one skilled in the art without departing from the true scope and spirit of the invention.

I claim:

1. A car and hoistway door coupling apparatus for an elevator having an elevator car with a sliding door for closing an opening to said car; means for moving said car door across said opening; a hoistway for said car with a hoistway sliding door for closing an opening to said hoistway; an interlock mechanism including a locking device mounted on said hoistway door and operable to lock said hoistway door in a closed position across its associated opening, said car and hoistway door coupling apparatus comprising, a vertical vane on the car door, a first roller on the hoistway door and a second roller on the interlock device, said rollers disposed to receive the vane therebetween, to couple said hoistway door to said car door during movement of said car door across its associated opening in both the opening and closing directions, so that said hoistway door moves across its associated opening in conjunction with the movement of said car door across its associated opening, and to decouple said car door and said hoistway door during the closing operation of said doors when said hoistway door reaches a predetermined distance from said closed position, characterized in that:

said second roller is swingably attached to said interlock device for swinging movement relative to said locking device about a pivot axis that is normal to the plane of said car door so as to be movable about the pivot axis between positions that are at different distances from said first roller along the direction in which said car door moves, and at one of said positions said second roller is restrained from further pivotal motion by said interlock device in the direction in which said vane moves as said car door opens, by which said vane is mechanically connected to said hoistway door for opening said hoistway.

2. The apparatus of claim 1, characterized in that said second roller is resiliently biased at said one position.

* * * * *